US005850937A

United States Patent [19]

Rauche

[11] Patent Number: 5,850,937

[45] Date of Patent: Dec. 22, 1998

[54] DISPENSER WITH MEANS FOR ALERTING A USER

[76] Inventor: Stephen J. Rauche, RR#1 Deep River, Ontario, Canada, K0J1PO

[21] Appl. No.: 911,284

[22] Filed: Aug. 14, 1997

[51] Int. Cl.[6] ..... G07F 11/62

[52] U.S. Cl. ..... 221/2; 221/3; 221/5; 221/8; 221/12; 221/15

[58] Field of Search ..... 221/15, 3, 5, 8, 221/12, 2

[56] References Cited

U.S. PATENT DOCUMENTS

| | | | |
|---|---|---|---|
| 4,572,403 | 2/1986 | Benaroya | 221/15 |
| 4,717,042 | 1/1988 | McLaughlin | 221/15 |
| 4,763,810 | 8/1988 | Christiansen | 221/15 |
| 4,785,969 | 11/1988 | McLaughlin | 221/15 |
| 5,522,525 | 6/1996 | McLaughlin et al. | 221/15 |
| 5,646,912 | 7/1997 | Cousin | 221/15 |
| 5,710,551 | 1/1998 | Ridgeway | 221/15 |

*Primary Examiner*—William E. Terrell
*Assistant Examiner*—Patrick Mackey

[57] ABSTRACT

A pill dispenser with means is provided for alerting a user when medication must be taken. The dispenser includes a housing having a top face with at least one compartment formed therein and a lid having a first orientation for allowing access to the corresponding compartment and a second orientation for precluding access thereto. A real time clock is situated within the interior space of the housing for tracking a present time. Memory is included for storing a plurality of medication time. Further provided is a selector mechanism including a plurality of buttons for allowing the entering and storage of a plurality of medication times within the memory by a user. A plurality of alarm mechanisms are included and adapted to alert a user upon the actuatin thereof. Finally, a control mechanism is included for actuating at least one selected alarm mechanism upon the matching of the present time and at least one of the medication times within the memory.

1 Claim, 5 Drawing Sheets

30
LID LATCH SOLENOID #1
LID LATCH SOLENOID #2
+V
+V
34
R.T.C.
NOVRAM
50
μC
56
52
PIEZO BUZZER
42
INDICATOR LIGHT
44
VIBRATOR MOTOR
46
LOCAL AREA PAGING TX
48
BUTTON MATRIX
40
DISPLAY
36
V REG
+V
LOW VOLT. DETECT
60
LOW BATT
61
62
58

70
LOCAL AREA PAGING RX
72

DISPENSER WITH MEANS FOR ALERTING A USER

BACKGROUND OF THE INVENTION

1. Field of the Invention

The present invention relates to a pill dispenser with means for alerting a user and more particularly pertains to reminding a user when medication must be taken and further preventing unauthorized access to such medication.

2. Description of the Prior Art

The use of pill dispensers is known in the prior art. More specifically, pill dispensers heretofore devised and utilized for the purpose of dispensing various medications are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,838,453; U.S. Pat. No. 5,200,891; U.S. Pat. Des. No. 279,551; U.S. Pat. No. 5,221,024; U.S. Pat. No. 5,044,514; and U.S. Pat. No. 5,014,875.

In this respect, the pill dispenser with means for alerting a user according to the present invention substantially departs from the conventional concepts and designs of the prior art, and in so doing provides an apparatus primarily developed for the purpose of reminding a user when medication must be taken and further preventing unauthorized access to such medication.

Therefore, it can be appreciated that there exists a continuing need for a new and improved pill dispenser with means for alerting a user which can be used for reminding a user when medication must be taken and further preventing unauthorized access to such medication. In this regard, the present invention substantially fulfills this need.

SUMMARY OF THE INVENTION

In view of the foregoing disadvantages inherent in the known types of pill dispensers now present in the prior art, the present invention provides an improved pill dispenser with means for alerting a user. As such, the general purpose of the present invention, which will be described subsequently in greater detail, is to provide a new and improved pill dispenser with means for alerting a user which has all the advantages of the prior art and none of the disadvantages.

To attain this, the present invention essentially comprises a housing having a top face, a bottom face, and a periphery formed therebetween defining an interior space. The top face has a plurality of compartments formed therein. Each of the compartments is equipped with a lid hingably coupled adjacent thereto. As such, each lid is adapted for pivoting between a raised orientation for allowing access to the corresponding compartment and a lowered orientation for precluding access thereto. To selectively preclude access to the compartments, a plurality of solenoids are each situated within the housing adjacent to an associated one of the compartments. In use, the solenoids serve to maintain the lid in the lowered orientation thereof upon actuation and further allow the lid to be pivoted to a raised orientation upon the deactuation thereof. Next provided is a real time clock situated within an interior space of the housing for tracking a present time. For a purpose that will become apparent hereinafter, a display is situated on the top face of the housing to depict a plurality of alphanumeric characters. Also situated on the top face of the housing is a matrix of push buttons for entering a code sequence upon the sequential depression thereof. Also included is a plurality of alarm means. Such alarm means includes a buzzer situated on the top face of the housing for emitting an audio signal upon actuation. Associated therewith is a light situated on the top face of the housing for illuminating upon actuation. For vibrating the housing upon actuation, a vibrator means is situated within the interior space of the housing. To accomplish such a task, the vibration means preferably includes a motor is a disk-shaped weight eccentrically coupled to a rotor thereof. Lastly, a transmitter is situated within the interior space of the housing. During operation, the transmitter is adapted to transmit via free space an activation signal upon actuation. As shown in FIG. 6, memory means is situated within the interior space of the housing. The memory means functions to store a plurality of medication times and a plurality of box codes associated therewith. To allow a user to the enter and store a plurality of medication times within the memory means, a selector means is provided. It should be noted that the selector means further allows the storage of a box code with each medication time. As shown in FIGS. 3 & 4, the selector means includes a plurality of buttons. During operation, the display functions to facilitate the entering of the medication times and box codes. Control means is situated within the housing and connected to the solenoids, clock, display, push buttons, buzzer, light, vibrator means, transmitter, memory means, and selector means. In use, the control means has a plurality of modes governed by a selector dial. In each mode, the control means is adapted to actuate one of the alarm means upon the matching of the present time and at least one of the medication times within the memory means. For example, the control means has a first mode of operation wherein the buzzer is actuated, a second mode of operation wherein the light is actuated, a third mode of operation wherein the vibrator is actuated, and a fourth mode of operation wherein the transmitter is actuated. The control means is further adapted to effect the continuous actuation of the solenoids except upon the matching of the present time and at least one of the medication times and the receipt of a proper code sequence. When such criterion is met, the only solenoid that is deactuated is that associated with the compartment which corresponds to the box code that accompanies the medication set time that matches the present time. Finally, a portable receiver is provided having a speaker connected thereto for transmitting an audio signal upon the receipt of the activation signal via free space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pill dispenser with means for alerting a user which has all the advantages of the prior art pill dispensers and none of the disadvantages.

It is another object of the present invention to provide a new and improved pill dispenser with means for alerting a user which may be easily and efficiently manufactured and marketed.

It is a further object of the present invention to provide a new and improved pill dispenser with means for alerting a user which is of a durable and reliable construction.

An even further object of the present invention is to provide a new and improved pill dispenser with means for alerting a user which is susceptible of a low cost of manufacture with regard to both materials and labor, and which accordingly is then susceptible of low prices of sale to the consuming public, thereby making such pill dispenser with means for alerting a user economically available to the buying public.

Still yet another object of the present invention is to provide a new and improved pill dispenser with means for alerting a user which provides in the apparatuses and methods of the prior art some of the advantages thereof, while simultaneously overcoming some of the disadvantages normally associated therewith.

Still another object of the present invention is to remind a user when medication must be taken and further prevent unauthorized access to such medication.

Lastly, it is an object of the present invention to provide a new and improved pill dispenser with means for alerting a user when medication must be taken. The dispenser includes a housing having a top face with at least one compartment formed therein and a lid having a first orientation for allowing access to the corresponding compartment and a second orientation for precluding access thereto. A real time clock is situated within the interior space of the housing for tracking a present time. Memory is included for storing a plurality of medication time. Further provided is a selector mechanism including a plurality of buttons for allowing the entering and storage of a plurality of medication times within the memory by a user. A plurality of alarm mechanisms are included and adapted to alert a user upon the actuation thereof. Finally, a control mechanism is included for actuating at least one selected alarm mechanism upon the matching of the present time and at least one of the medication times within the memory.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
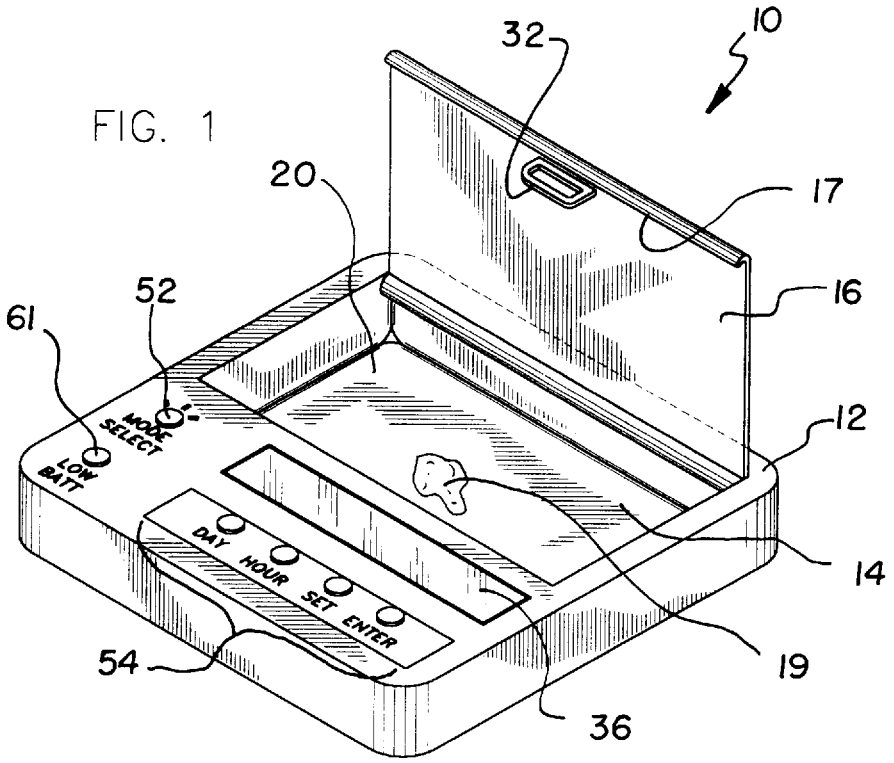
FIG. 1 is a perspective illustration of the preferred embodiment of the pill dispenser with means for alerting a user constructed in accordance with the principles of the present invention.

With reference now to the drawings, and in particular to FIG. 1 thereof, a new and improved pill dispenser with means for alerting a user embodying the principles and concepts of the present invention and generally designated by the reference numeral 10 will be described.

The present invention, the new and improved pill dispenser with means for alerting a user, is comprised of a plurality of components. Such components in their broadest context include a housing, a plurality of compartments, a plurality of alarm means, & control means. Such components are individually configured and correlated with respect to each other so as to attain the desired objective.

More specifically, it will be noted that the system 10 of the present invention includes a housing 12 having a top face, a bottom face, and a periphery formed therebetween defining an interior space. The top face has at least one compartment 14 formed therein. Each of the compartments is equipped with a lid 16 hingably coupled adjacent thereto. As such, each lid is adapted for pivoting between a raised orientation for allowing access to the corresponding compartment and a lowered orientation for precluding access thereto. Ideally, each lid is equipped with a arcuate double lip 17 or the like for precluding the lid from being pried open. See FIG. 1.

Options which may be incorporated with the housing include a compartment 18 for an inhaler. Further, various mounting mechanisms such as a pile fastener 19 may be employed to mount the housing in various locations. As yet a further option, the housing may be formed from a transparent material for allowing a medication summary log sheet situated therein to be viewed from an exterior of the housing.

Figure 2:
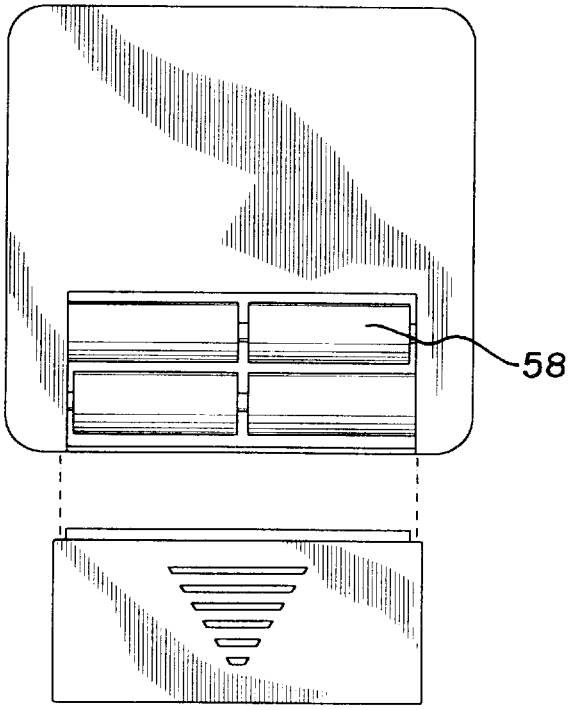
FIG. 2 is a bottom view of the present invention.
Figure 3:
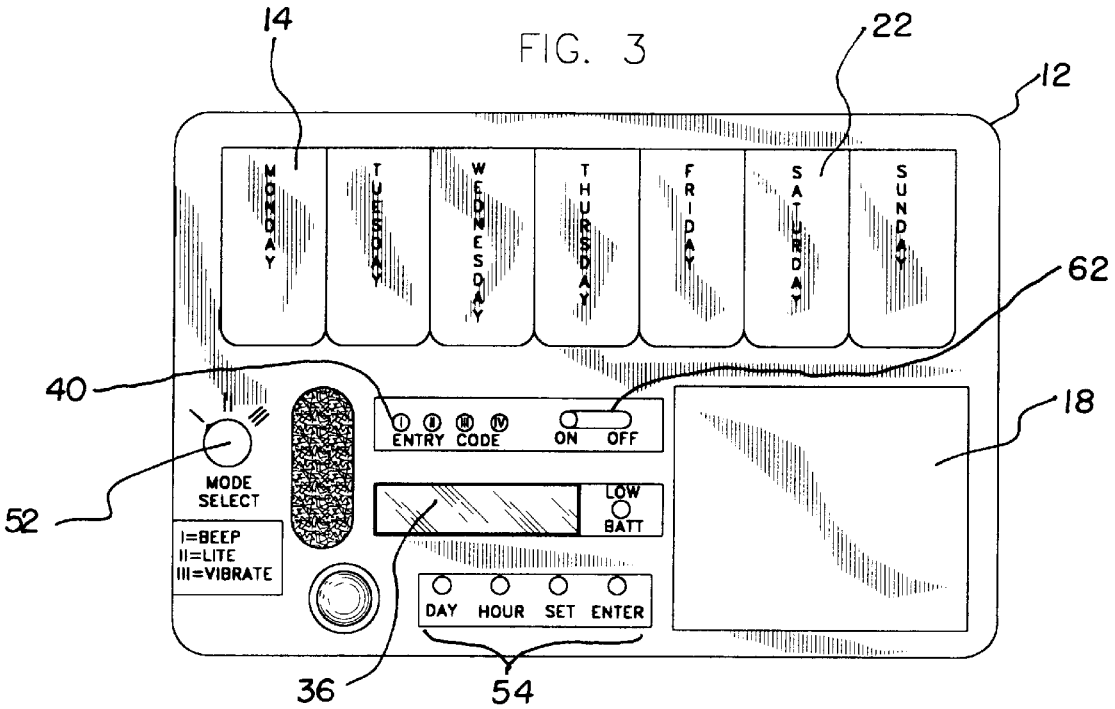
FIG. 3 is a top view of an alternate embodiment of the housing of the present invention.
Figure 4:
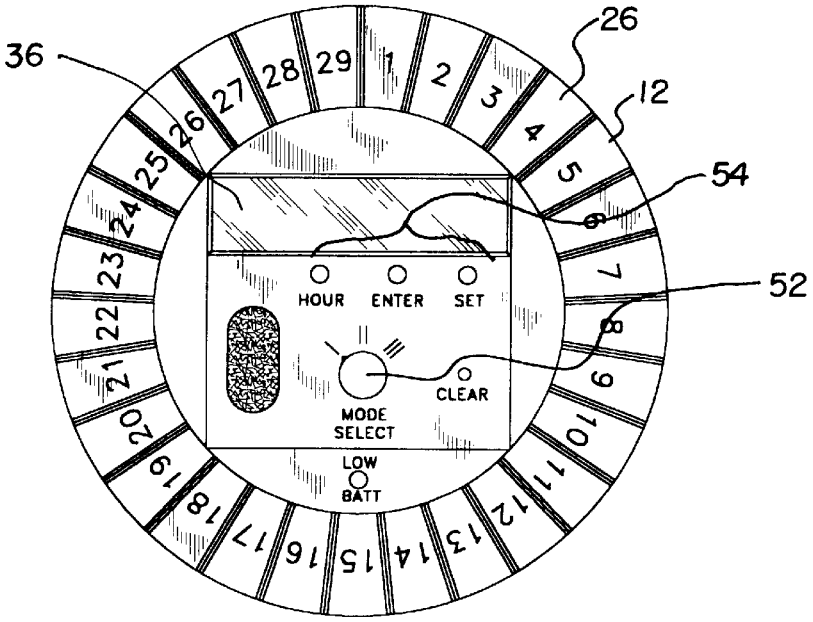
FIG. 4 is a top view of an alternate embodiment of the present invention.

As shown in FIGS. 1–4, various housing types may be utilized for various purposes. FIGS. 1 & 2 depict a housing with a single large compartment 20 adapted to contain a plethora of pills. FIG. 3 depicts an alternate embodiment of the housing which has a plurality of linearly aligned compartments 22 each having a day indicia printed thereon. As an option, the indicia may be supplemented with braille lettering. Such embodiment is ideal for use with mediation that must be taken during the course of a week. Finally, yet another embodiment, as shown in FIG. 4, includes a plurality of compartments 26 with an annular configuration and a day indicia printed thereon. This embodiment is adapted for dispensing pills or medication on a monthly basis, such as birth control pills.

To selectively preclude access to the compartments, a plurality of solenoids 30 are each situated within the housing adjacent to an associated one of the compartments. In use, the solenoids serve to maintain the lid in the lowered orientation upon actuation and further allow the lid to be pivoted to a raised orientation upon deactuation. To accomplish the foregoing function each lid preferably has a closed loop 32 formed on a bottom thereof through which a transducer of the solenoid may pass.

Next provided is a real time clock 34 situated within the interior space of the housing for tracking a present time. It should be noted that in the present description, a present time may include a day and a week. For a purpose that will become apparent hereinafter, a display 36 is situated on the top face of the housing to depict a plurality of alphanumeric characters. Also situated on the top face of the housing is a matrix of numeric push buttons 40 for entering a code sequence, or PIN, upon the sequential depression thereof.

Also included is a plurality of alarm means. Such alarm means includes a buzzer 42 situated on the top face of the housing for emitting an audio signal upon actuation. Associated therewith is a light 44 situated on the top face of the housing for illuminating upon actuation. For vibrating the housing, a vibrator means 46 is situated within the interior space of the housing. To accomplish such a task, the vibration means preferably includes a motor with a disk-shaped weight eccentrically coupled to a rotor thereof. Lastly, a transmitter 48 is situated within the interior space of the housing. During operation, the transmitter is adapted to transmit via free space an activation signal upon actuation.

Figure 6:
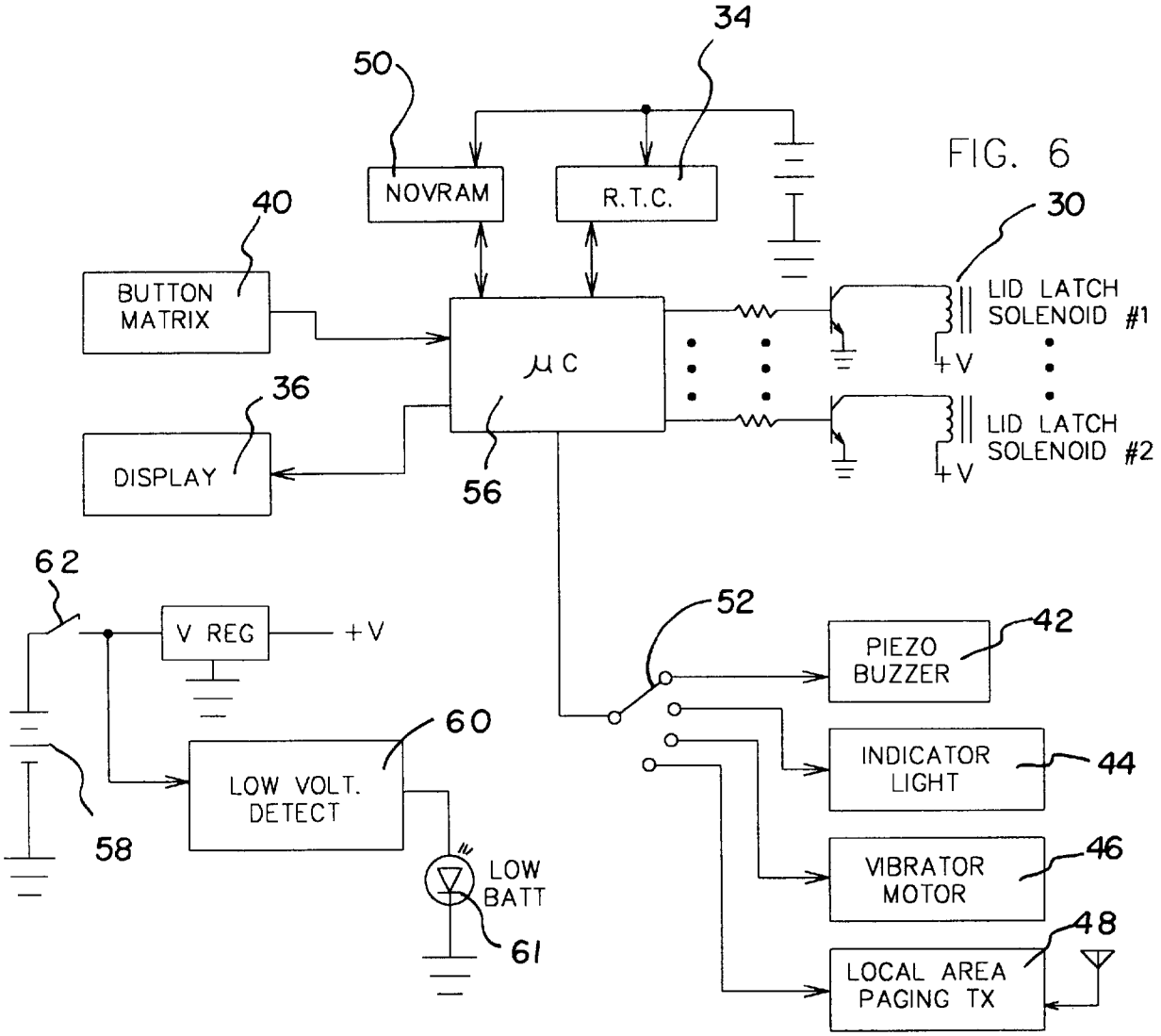
FIG. 6 is a schematic diagram of the various electrical components connected to the control means of the present invention.
Figure 7:
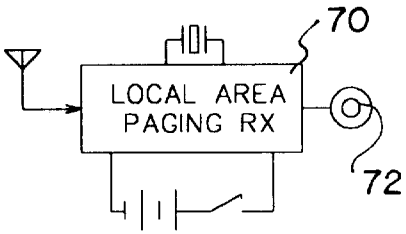
FIG. 7 is a schematic diagram of the receiver of the present invention.

As shown in FIG. 6, random access memory means 50 is situated within the interior space of the housing. The memory means functions to store a plurality of medication times and a plurality of box codes associated therewith. A proper code sequence, or PIN, is also stored in the memory means. To allow a user to the enter and store a plurality of medication times within the memory means, a selector means 52 is provided. It should be noted that the selector means further allows the storage of a box code with each medication time. To accomplish this, a plurality of buttons 54 including a hour button, day button, set button, an enter button, and a PIN button are provided. During operation, the display functions to facilitate the entry of the medication times and box codes. It should be noted taut the various forgoing buttons may also be utilized to change the PIN and the present time. Such operation is similar to that employed in the art of clock radios.

Figure 5:
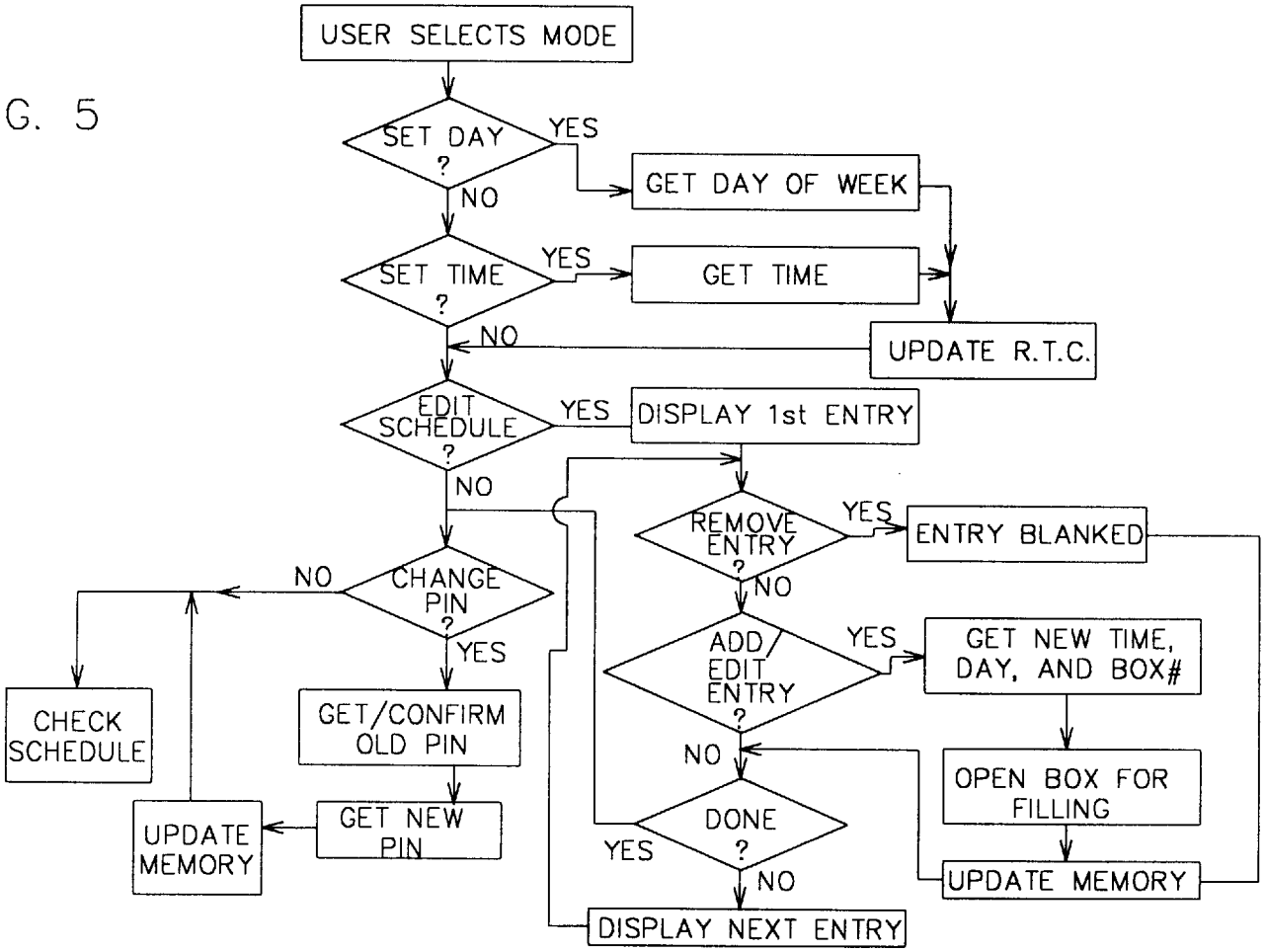
FIG. 5 is a flow chart depicting the method of which the medication times and proper code sequence may be edited.

The method associated with the entry and editing of the medication times and proper code sequence is shown in FIG. 5. As shown, when editing the medication times, the user is given the choice of removing or adding entries. When adding entries in the form of a mediation time and box code, the solenoid of the compartment associated with the box code is temporarily deactuated for filling of the compartment with pills. When editing the PIN, the selector means requires that the previous PIN be entered. As an option, the selector means may further require the entry of the PIN when adding and removing the medication times.

Figure 8:
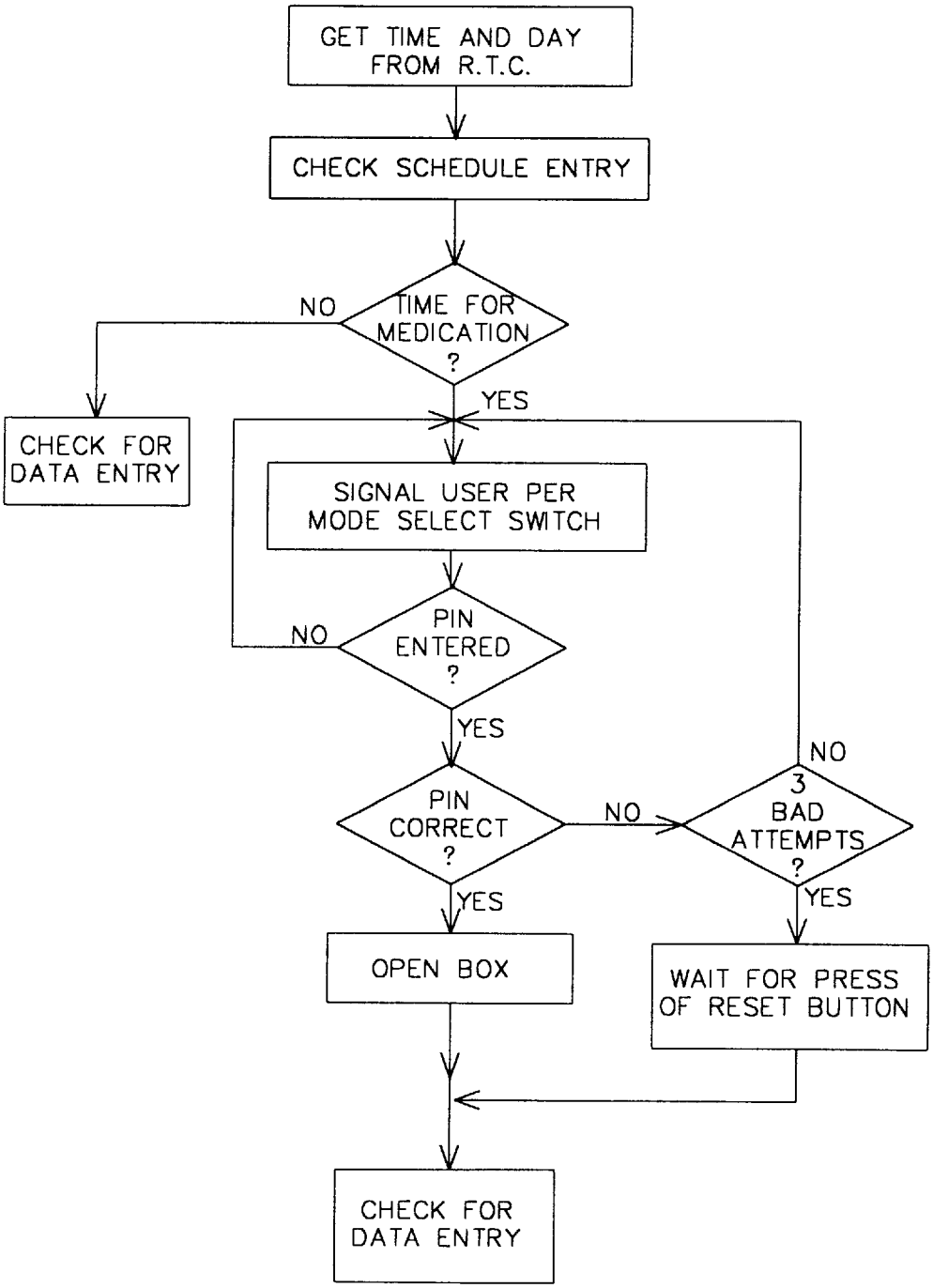
FIG. 8 is a flow chart depicting the method of which the present invention operates.

Control means 56 is situated within the housing and connected to the solenoids, clock, display, push buttons, buzzer, light, vibrator means, transmitter, memory means, and selector means. The control means is further connected to at least one battery 58 which has a low power detection means 60 associated therewith for reliable powering purposes. To alert a user of a low power condition, a light emitting diode 61 is provided. A push and lock power switch 62 is also included. Such switch prevents the inadvertent deactuation of the device. It should be understood that when the present invention is powered down, all functions except those associated with the selector means are still implemented. The method of which the control means governs the operation of the forgoing components is shown in FIG. 8.

In use, the control means has a plurality of modes governed by a selector dial. In each mode, the control means is adapted to actuate one of the alarm means upon the matching of the present time and at least one of the medication times within the memory means. For example, the control means has a first mode of operation wherein the buzzer is actuated, a second mode of operation wherein the light is actuated, a third mode of operation wherein the vibrator is actuated, and a fourth mode of operation wherein the transmitter is actuated.

The control means is further adapted to effect the continuous actuation of the solenoids except upon the matching of the present time and at least one of the medication times and the receipt of a proper code sequence. When such criterion is met, the only solenoid that is deactuated is that associated with the compartment which corresponds to the box code. It should be noted that such box code accompanies the medication set time that matches the present time. As shown in FIG. 8, the control means is adapted to require the depression of a discreetly positioned reset button upon the entry of at least three improper code sequences.

Finally, a portable receiver 70 is provided having a speaker 72 connected thereto for transmitting an audio signal upon the receipt of the activation signal via free space. The receiver thus serves to alert a user distanced from the housing that it is time to take medication.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pill dispenser with means for alerting a user comprising, in combination:

a transparent housing having a top face, a bottom face, and a periphery formed therebetween defining an interior space, the top face having a plurality of compartments formed therein each with a lid hingably coupled adjacent thereto for pivoting between a raised orientation for allowing access to the corresponding compartment and a lowered orientation for precluding access thereto, wherein each lid has indicia situated thereon and is equipped with an arcuate double lip for precluding the lid from being pried open, wherein a medication summary log sheet is situated within the housing and is viewed from an exterior of the transparent housing;

a mount situated within at least one of the compartments for releasably mounting an inhaler thereon;

a plurality of solenoids each situated within the housing adjacent to an associated one of the compartments for maintaining the lid in the lowered orientation thereof upon the actuation thereof and further allow the lid to be pivoted to a raised orientation upon the deactuation thereof;

a real time clock situated within an interior space of the housing for tracking a present time;

a display situated on the top face of the housing for displaying a plurality of alphanumeric characters;

a matrix of push buttons for entering a code sequence upon the sequential depression thereof;

a buzzer situated on the top face of the housing for emitting an audio signal upon the actuation thereof;

a light situated on the top face of the housing for illuminating upon the actuation thereof;

vibrator means situated within the interior space of the housing for vibrating the housing upon the actuation thereof;

a transmitter situated within the interior space of the housing and adapted to transmit via free space an activation signal upon the actuation thereof;

memory means situated within the interior space of the housing for storing a plurality of medication times, a proper code sequence, and a plurality of box codes associated therewith;

selector means including a plurality of buttons for allowing the entering and storage of a plurality of medication times within the memory means by a user, wherein the time selector means further allows the storage of a box code with each medication time and the display functions to facilitate said entering of the medication times and box codes; and control means situated within the housing and connected to the solenoids, clock, display, push buttons, buzzer, light, vibrator means, transmitter, memory means, and selector means, the control means having a first mode of operation wherein the buzzer is actuated upon the matching of the present time and at least one of the medication times within the memory means, a second mode of operation wherein the light is actuated upon the matching of the present time and at least one of the medication times within the memory means, a third mode of operation wherein the vibrator is actuated upon the matching of the present time and at least one of the medication times within the memory means, and a fourth mode of operation wherein the transmitter is actuated upon the matching of the present time and at least one of the medication times within the memory means, wherein the current mode of operation is selected by way of a dial situated on the top surface of the housing, the control means further adapted effect the continuous actuation of the solenoids except upon the matching of the present time and at least one of the medication times and the receipt of the proper code sequence whereafter the only solenoid that is deactuated is that associated with the compartment which corresponds to the box code that accompanies the medication set time that matches the present time; and a portable receiver having a speaker connected thereto for transmitting an audio signal upon the receipt of the activation signal via free space;

wherein a lower power indication means is included for indicating when a battery is low.

* * * * *